United States Patent [19]

Parks et al.

[11] 4,050,257

[45] Sept. 27, 1977

[54] DEMOUNTABLE DOCK ASSEMBLY

[76] Inventors: Blanchard St. Clair Parks, 311 Bunting Rd., Unit 22, St. Catharines, Ontario; Bernette Frederick Parks, 35 Whyte Ave., Thorold, Ontario, both of Canada

[21] Appl. No.: 637,458

[22] Filed: Dec. 3, 1975

[51] Int. Cl.[2] ..... E02B 3/20; E04B 1/00

[52] U.S. Cl. ..... 61/48; 52/263; 182/178; 182/222

[58] Field of Search ..... 182/179, 178; 403/169–178; 61/48, 64, 65; 108/64; 52/263

[56] References Cited

U.S. PATENT DOCUMENTS

| | | | |
|---|---|---|---|
| 2,936,530 | 5/1960 | Bowen | 403/177 |
| 3,074,239 | 1/1963 | Mustard | 61/48 |
| 3,158,003 | 11/1964 | Dally | 61/48 |
| 3,208,227 | 9/1965 | Armbrust | 61/48 |
| 3,345,825 | 10/1967 | Parker | 61/48 |
| 3,564,802 | 2/1972 | Dreyfus | 182/179 |

FOREIGN PATENT DOCUMENTS

| | | | |
|---|---|---|---|
| 202,301 | 3/1959 | Austria | 182/179 |
| 1,514,258 | 1/1968 | France | 403/175 |

*Primary Examiner*—Reinaldo P. Machado
*Attorney, Agent, or Firm*—W. Charles Kent

[57] ABSTRACT

An economical, lightweight, easily assembled and disassembled dock assembly. The elements of the assembly comprise a plurality of anchor posts, a connector to be secured about each of the anchor posts at a predetermined height, the connector having at least two arms extending outwardly from a central portion thereof, at least one open ended tubular beam to extend between adjacent anchor posts, each of the ends of each of the beams to receive in snug engagement one of the arms of the connectors, the cross-sectional outer profile of each of the arms being of slightly smaller size and conforming to the cross-sectional inner profile of the cooperating tubular beams, removable locking means to prevent unpurposeful disengagement of each of the cooperating beam ends and connector arms from their position in snug engagement, one or more panel sections supported by the beams when positioned thereabove and securing means associated with the beams to prevent lateral displacement of the panel sections when in position above the beams.

13 Claims, 8 Drawing Figures

DEMOUNTABLE DOCK ASSEMBLY

BACKGROUND OF THE INVENTION

This invention relates to a demountable frame and panel assembly for use in a solid base, and more particularly concerns such an assembly made from open-ended tubular beams for use in a platform or dock which may be readily erected or taken down.

Demountable frame and panel assemblies are particularly useful as portable platforms or portable docks. In this latter instance, ice conditions during the winter in many areas make it necessary to remove from the water all but the most permanent types of docks, in order to prevent damage or destruction to the dock by the ice. Heretofore, conventional demountable or portable docks have been constructed with a series of spaced posts, and connector means attached to such posts and to either rigid platform form sections or support beams extending between the posts (in which case platform sections are supported on such beams). Examples of such constructions can be seen in U.S. Pat. No. 2,592,626 of Wanless, and Canadian Pat. Nos. 480,575 of Nelges et al., 647,768 of Fisher, 660,089 of Fentiman, 690,876 of Mustard, 874,172 of Hiebert and 928,089 of Nordell. Such constructions have generally involved anchor plates welded to the posts or slidably secured thereon, these plates being slotted or otherwise arranged to releasably engage pins or other projections on the sides or corners of platform sections. Hiebert, Canadian Pat. No. 874,172 describes and illustrates a construction in which the anchor plates are located at the corners of the platform sections, the platform sections additionally having sliding tube posts welded to their sides for supporting the platform sections on the posts. All of such constructions however require relatively complicated parts as well as close tolerances to ensure that the respective pins will align themselves with the slots in the anchor plates for secure engagement. Consequently they have relatively high construction costs. Many of these constructions have cumbersome and heavy component parts, requiring several persons and a variety of tools to assemble or take down the dock.

Fentiman, Canadian Pat. No. 660,089 describes and illustrates a dock construction in which platform sections are suspended from posts by means of adjustable chains. Again, however, the construction described is relatively complicated, resulting in a relatively costly product on the market place.

More generally, connectors for tubular beams are well-known in the art. See, for example, Canadian Pat. No. 870,861 of F. W. Reilly, issued May 18, 1971; U.S. Pat. Nos. 3,008,741 of P. MacCormack, issued Nov. 14, 1961; 3,021,159 of H. Back, issued Feb. 13, 1962; 3,033,598 of C. A. V. Polgar, issued May 8, 1962; 3,089,716 of I. L. Berkowitz, issued May 14, 1963; 3,218,097 of P. Bowers, et al., issued Nov. 16, 1965; 3,356,394 of G. Chamayou, issued Dec. 5, 1967; 3,357,727 of W. R. Finkenstein, et al., issued Dec. 12, 1967; 3,472,539 of J. G. Fenwick, issued Oct. 14, 1969; 3,556,569 of K. N. Bruhn, issued Jan. 19, 1971; 3,580,620 of A. G. Offenbroich, issued May 25, 1971 and 3,645,569 of F. W. Reilly. In most cases, these connectors comprise a central block or portion with at least two arms extending outwardly therefrom. Many of these connectors are complicated and expensive to construct; many require numerous parts and fittings making them unsuitable for repeated erection and demounting of platforms or docks. In addition, such known constructions do not combine the features of durability and ability to withstand relatively high loading stresses, rigidity and ability to resist, e.g. winds and wave motion, and versatility, such as the ability to adjust the height of a platform or dock section associated with such connectors and beams.

Consequently, it is an object of the present invention to provide a demountable frame and panel assembly which will be particularly useful as a platform or dock, being easily adjustable to differing heights, and made of sturdy lightweight materals and of economical, easy-to-make components. It is a further object of this invention to provide such a demountable assembly which may be erected or taken down by one or two persons, using no more than a screw-driver or a wrench. It is yet a further object of the present invention to provide such a demountable assembly of lightweight elements which may be carried by a single person, yet which when assembled will provide a stable, strong structure capable of resisting the effects of wind or waves, and which will be capable of withstanding relatively large loading weights.

In accordance with the invention, a demountable frame and panel assembly for use in a solid base is provided comprising a plurality of anchor posts, a connector slidable along and about each of said anchor posts, the connector having at least two arms extending outwardly from a central portion thereof and lying at an angle to the direction of the longitudinal axis of the post when positioned thereabout, and at least one open-ended tubular beam to extend between adjacent anchor posts. A connector securing means associated with each connector secures the connector at a predetermined position on the anchor post. Each of the ends of the beams are adapted to receive, in snug engagement, one of the arms of one of the connectors, the cross-sectional outer profile of each of the arms being of slightly smaller size and conforming to the cross-sectional inner profile of the cooperating tubular beams. One or more panel sections is supported by these beams. Removable locking means are provided to prevent unpurposeful disengagement of each of the cooperating beam ends and connector arms from their position in snug engagement. Securing means are preferably provided with the beams or panel sections to prevent lateral displacement of the panel sections when in position above the beams.

Such a demountable frame and panel assembly is ideally suited as a platform assembly for land or water, e.g. a portable dock. It is also envisaged that such an assembly would have other applications, e.g. for use as scaffolding.

BRIEF DESCRIPTION OF THE DRAWINGS

These and other objects and advantages of the invention will become apparent upon reading the following detailed description and upon referring to the drawings in which.

DETAILED DESCRIPTION OF THE INVENTION

Figure 5:
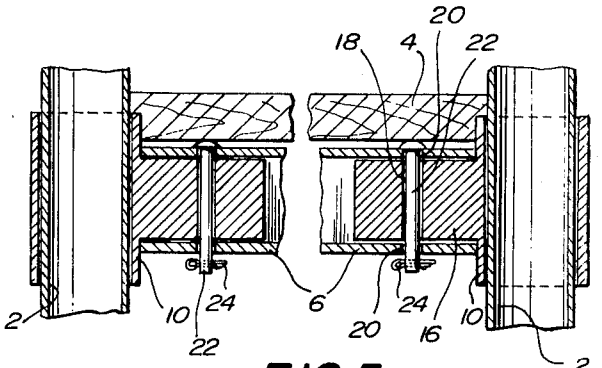
FIG. 5 is a sectional view of an upper portion of the assembled dock assembly taken along lines V—V.

In the following description, similar features are identified with identical reference numerals.

Figure 1:
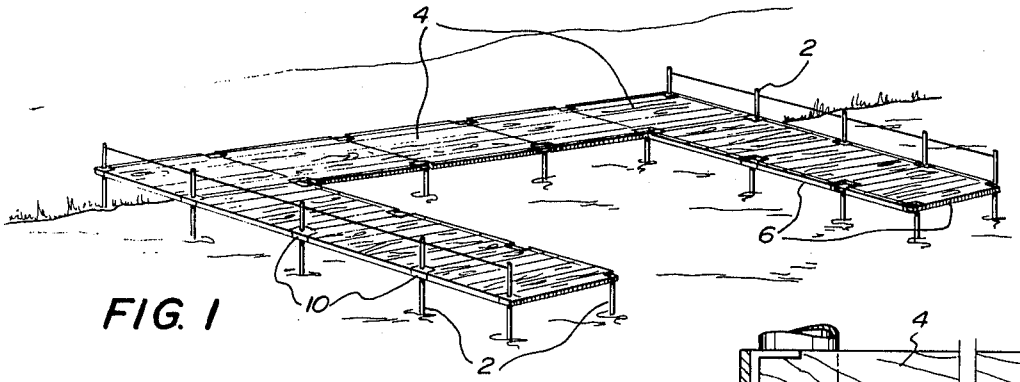
FIG. 1 is a perspective view of a demountable building assembly used as a dock according to the present invention.

Turning first to FIG. 1, there is shown a dock structure assembled from anchor posts 2, platform sections 4 and tubular beams 6.

Anchor posts 2 should be secured in any suitable base, which may be for example ground or the bed of a lake or river. Depending upon the degree of portability desired, some or all of the anchor posts desired might be secured in suitable cement footings. Alternatively, as seen in FIG. 2, appropriate spike and plate bases 3 are secured to the lower ends of posts 2 to enable the posts to be driven into rocky, sandy or earth bases and secure the posts in place.

Platform sections 4 may be made of any suitable material. For example, these sections may be made of spaced wooden slats suitably secured for example by means of a metal brace 7 (FIGS. 2 and 4) extending along the ends of the planks and outer edges of the platform sections. Alternatively, it is envisaged that the platform sections might be constructed of suitable metal, e.g. aluminum sheeting or sturdy plastic sheets of an appropriate size and shape to suit the particular beam or frame assembly used.

Figure 2:
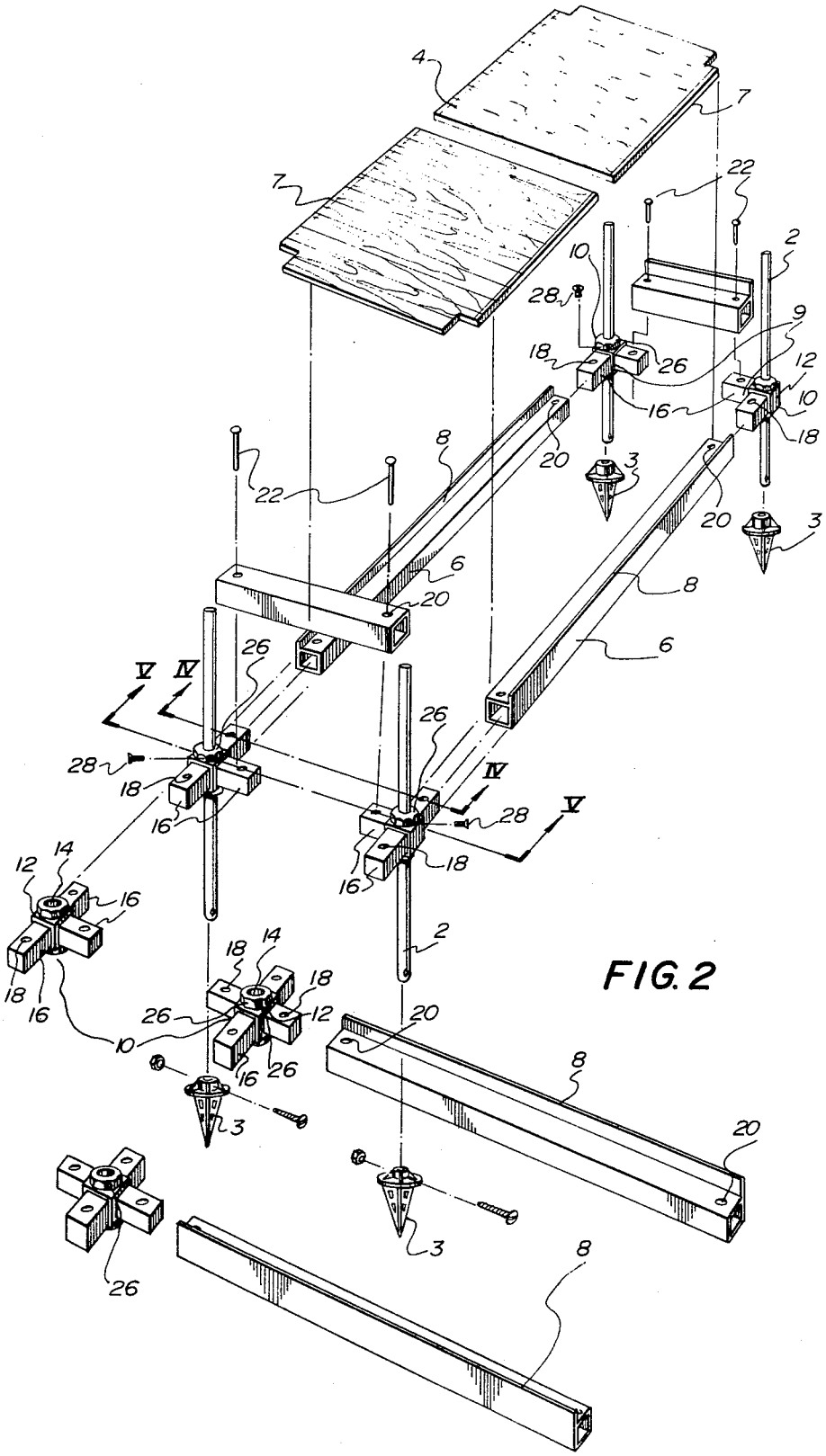
FIG. 2 (on the second page of drawings) is an exploded view of a section of the demountable dock assembly of FIG. 1.

As can be seen from FIG. 2, tubular beams 6 are square in cross-section, and have a flange 8 extending upwardly as an integral extension of one surface. This flange is positioned adjacent peripheral portions of the platform sections to secure the sections against lateral displacement. While not shown in the drawings, it is of course envisaged that the cross-sectional profile of the tubular beam may be other than square-for example, circular or non-square rectangular cross-sectional shapes are envisaged within the scope of this invention, although the square or rectangular cross-section, and particularly the square, is preferred. In addition, the means for securing the platform sections against lateral displacement may be other than flange portion 8 as illustrated: for instance, such securing means might take the form of extensions or lugs (not shown) extending downwardly from the under portions of the platform sections 4, aligned to fit into cooperating holes (not shown) in tubular beams 6, or to extend into and bear against the inner corners 9 (FIG. 2) formed by the frame structures of assembled beams 6.

Figure 4:
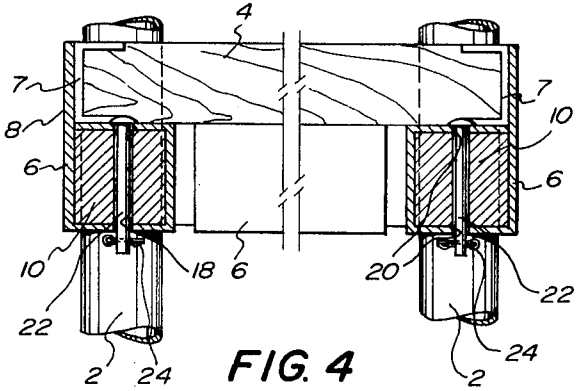
FIG. 4 is a sectional view of the upper portion of the assembled dock assembly taken along line IV—IV of FIG. 2.
Figure 3:
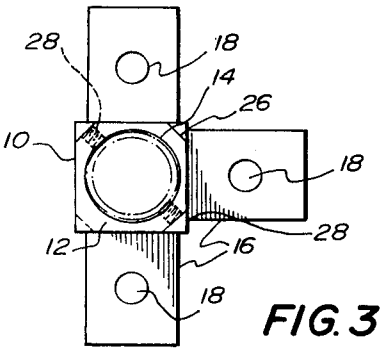
FIG. 3 is an enlarged plan view of a connector used in the assembly of FIG. 1.
Figure 6:
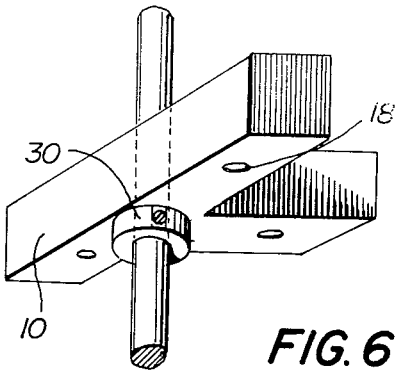
FIG. 6 is a perspective view of a connector and post according to the present invention showing an alternative method of securing the connector to a post.

As can be seen from FIGS. 2, 4 and 6, beams 6 are secured in position by means of connectors 10. As can be seen in FIGS. 2 or 3, each connector comprises a central portion 12 with hole 14 extending therethrough to receive an anchor post 2. Connector arms 16 extend outwardly from this central portion, and have a square cross-sectional profile (FIGS. 2 or 4) which are of slightly smaller size than the inner profiles of the ends of cooperating tubular beams so that an arm can be received in snug engagement by the end of one of the beams. It is preferred of course that these profiles be such that the beams are interchanged with respect to the connector arms. Again, of course, this cross-sectional profile of the connector arm 10 may be of other shapes, e.g. non-square or rectangular; so long as it is of a size slightly less than and conforms to the cross-sectional inner profile of the cooperating tubular beam end. As can be seen from FIGS. 2, 3 and 5, arms 16 of the connector extend at right angles to each other in a direction normal to the axis of hole 14 through central portion 12 of the connector. Whem the arms lie in a plane normal to this axis, assuming the posts are mounted vertically in a base, the platform assembly will have a horizontal orientation throughout. It is envisaged, as will be discussed later, that connector arms 16 might extend away from central portion 12 in a direction out of this plane, so that non-horizontal platform structures might be assembled.

As can be seen in FIGS. 2, 3, 4 and 5, connector arms 16 have apertures 18, alignable with apertures 20 in beams 6 when the respective arms and beams are in snug engagement to receive locking means 22 (being button pins in the Figures). FIGS. 4 and 5 are sectional views showing arm apertures 18 and beam apertures 20 in alignment, the respective arms and beams in snug engagement, with locking means 22 in place. A cottar pin 24 (FIGS. 4, 5) may be inserted through a hole in the end of locking means 22 to secure the same in place.

As can be seen in FIGS. 2 and 3, locking collar 26 fixed to or integral with connector 10 and extending about hole 14, in conjunction with set screw 28 threaded through it and bearing against anchor post 2 (shown in phantom in FIG. 3) acts to secure connector 10 at a proper height on anchor post 2. Any other suitable securing means may be used in conjunction with this locking collar to secure the connector to the post. Depending on the potential loading strength to be carried by the platform assembly, the size, nature and number of set screws or other securing means may be varied.

In FIG. 6, an alternative means of securing the connector at a given height on a post is shown. Here removable collars 30 are secured at a proper height on anchor posts 2. A connector 10 which may have no collar 26 or set screw 28 rests thereon.

It will be realized that with anchor posts of sufficient height, more than one level of platform may be erected on the same set of posts.

Figure 7:
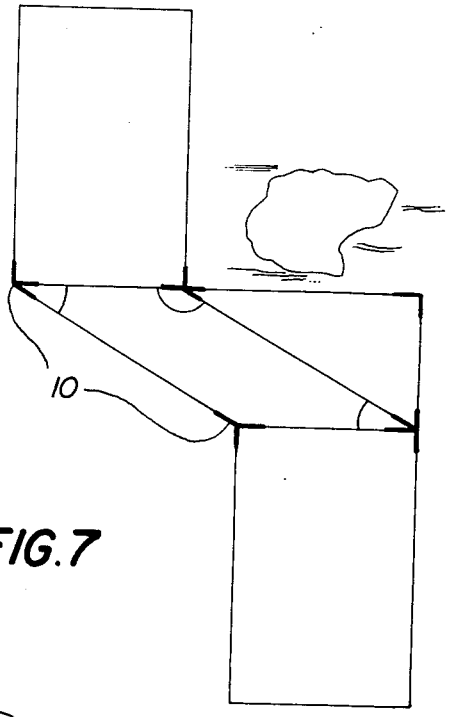
FIG. 7 is a plan, schematic view of a dock assembly made using a further embodiment of the connector according to the present invention.
Figure 8:
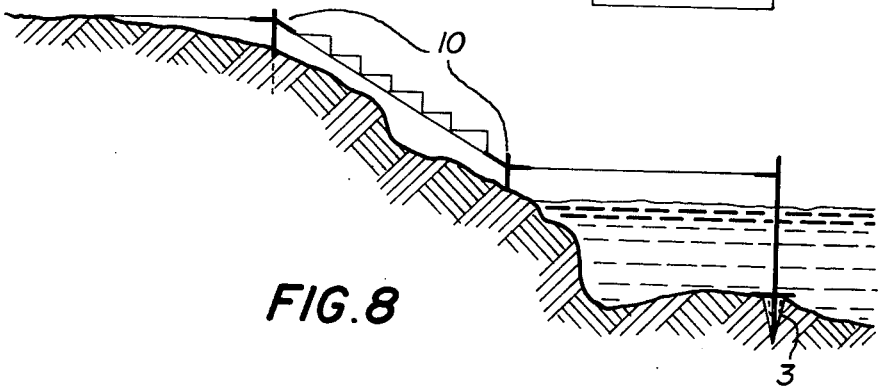
FIG. 8 is a schematic, elevational view of a dock assembly illustrating further embodiments of a connector and panel according to the present invention. While the invention will be described in connection with example embodiments, it will be understood that it is not intended to limit the invention to such embodiments. On the contrary, it is intended to cover all alternatives, modifications and equivalents as may be included within the spirit and scope of the inventionas defined by the appended claims.

As can be seen in FIG. 2 and FIG. 7, connectors according to the invention may be made in a number of different shapes, with, for example, 2, 3 or 4 or more arms extending from central portion 12, and arms extending from central portion 12 at a 90° angle to each other or at any other desired angle. As in FIG. 7, when angles other than 90° are involved, the rectangular or square beam assemblies and platform sections, which would be used with the constructions of FIGS. 1 and 2, might be of triangular or irregular shape. Moreover, as can be seen in FIG. 8, where the connector is constructed so that connector arms 16 are not normal to the anchor post 2 to which connector 10 is secured, for example where a platform section is being erected on sloping land, a platform of a desired slope may be obtained by proper orientation of the connector arm out of this plane normal to the axis of the anchor posts. The platform section instead of being flat, may be provided with steps as shown. Alternatively, a series of transverse planks might be positioned across adjacent side beams, appropriately notched to receive the planks at a series of different elevations, to provide such steps across sloping land.

A platform assembly or dock according to the present invention may be constructed with components which may be erected or disassembled by even a single person. To assemble a dock from the parts described and illustrated, e.g. in FIG. 2, two anchor posts 2 may be cemented in or simply driven into the ground. Two-way connectors 10 (with arms at 90° to each other) are secured at the desired height to these anchor posts. A tubular beam 6 extending across between these two anchor posts receives facing arms 16 of these connectors and the connectors and beam are secured in place by locking means (button pins) 22 which are inserted through non-aligned arm and beam apertures 18 and 20. Alternatively, for this step, connectors 10 and this cross-beam 6 may be preassembled and locked in place by locking means 22, after which the entire assembly is slipped over anchor posts 2 and locked at the desired height by tightening set screws 28.

A second cross-beam assembly is preassembled in the same manner, this time using for example the middle arms 16 of three-way connectors 10 (having three arms, each at 90° to each other). When the cross-beam assembly is locked together with locking means 22, that assembly is slipped over two anchor posts and locked into position at the desired height (for a dock this may be approximately 1 foot above the water depth established at the spot where the anchor posts will be placed).

Two side beams 6 are then fitted into engagement over end arms 16 of these two connectors and locked in place as before. The cross and side beam assembly thus constructed is then placed into the water and the side beams 6 are slipped into engagement with the two free arms of the first two connectors and locked, to provide a rectangular or square beam-connector assembly having the anchor posts 2 at the four corners thereof. Platform sections 4 may then be placed into position above the frames. As weight is added to the platform assembly, the anchor posts may settle. If this happens the platform assembly may be levelled by loosening set screws 28 in the relevant connectors, and shifting these connectors to the proper level and tightening the set screws.

Any number of dock sections may be added using the same procedure. If right-angle docks are desired they can also be added by using four-way connectors (some are illustrated in FIG. 2) having four connector arms at 90° angles to each other. Similarly, if docks of other angles are desired, suitable connectors may be provided according to the present invention to permit such a dock to be erected.

The assembly procedure may of course vary from that described above, depending on particular dock or platform assemblies being used, and depending upon the terrain and working conditions at the site in question.

Disassembly of the platform may take place in any suitable manner, for example, following the suggested steps outlined above generally in reverse order.

Thus it is apparent that there has been provided in accordance with the invention a demountable frame and platform assembly that fully satisfies the objects, aims and advantages set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

What we claim is:

1. A demountable dock assembly for use beside and in a body of water comprising:

a. a plurality of anchor posts, the lower ends of each of which having associated therewith means for imbedding said post in a solid base;

b. a connector slidable along and about each of said anchor posts, said connector having at least two arms extending outwardly from a central portion of said connector, said arms lying at an angle to the direction of the longitudinal axis of the post when positioned thereabout;

c. means associated with each said connector to secure said connector at a predetermined position on said anchor post;

d. at least one open-ended tubular beam to extend between adjacent anchor posts, each of the end portions of each of said beams to receive in snug engagement one of the arms of said connectors, the cross-sectional outer profile of each of said arms being of slightly smaller size and conforming in shape to the cross-sectional inner profile of the cooperating tublular beams;

e. removable locking means to extend transversely through cooperating portions of said beams and said arms, to prevent unpurposeful longitudinal disengagement of each of said cooperating beams and connector arms from their position in snug engagement;

f. one or more panel sections supported by said beams each of said panel sections comprising a series of parallel spaced planks of common lengths and thicknesses, a U-shaped brace extending on opposite sides of the panel section embracing the ends of the planks to secure them in spaced relation;

g. said beams having associated therewith securing means comprising a longitudinal flange integral with and extending in the same plane as an exterior surface of said beams supporting outer edges of said panel sections, said plank braces seated on said beams and adjacent said flanges;

e. portions of said panel sections when in position supported by said beams lie above said removable locking means.

2. A demountable assembly according to claim 1, wherein said connector arms and beams have apertures extending from one side of each to the other, a pair of said apertures being aligned when the respective arm and beam are in snug engagement, and wherein one of said locking means is slidably positioned through said aligned apertures.

3. A demountable assembly according to claim 2, wherein said connector arms and beams have square cross-sectional profiles, and wherein said locking means are removably seated in aligned apertures extending from the upper surface of said arms and beams to the lower surfaces thereof.

4. A demountable assembly according to claim 2, wherein said locking means comprise button pins.

5. A demountable assembly according to claim 4, wherein a cottar pin through the end of said locking means extending through said aligned apertures secures said locking means in place to prevent unpurposeful disengagement of said respective arm and beam.

6. A demountable assembly according to claim 1, wherein a hole is provided through the central portion of the connector, said hole being of a size and shape to permit an anchor post about which it is secured to fit therethrough during assembly or demounting.

7. A demountable assembly according to claim 6, wherein said connector arms are located in a plane normal to the axis of the said hole through the central portion of the connector.

8. A demountable assembly according to claim 7, wherein said connector arms are positioned at 90° or 180° angles to each other.

9. A demountable assembly according to claims 6, wherein said connectors on said posts rest on removable collars secured to said poles at predetermined heights.

10. A demountable assembly according to claim 6, wherein said connector is provided with a set screw threaded through a side thereof to extend into said hole in the central portion of the connector to frictionally engage the outer surface of said anchor pole and secure said connector about said post at a predetermined position.

11. A demountable assembly according to claim 1, wherein the connector arms and beams have rectangular cross-sectional profiles.

12. A demountable assembly according to claim 1, wherein cross-sectional profiles of the connector arms and beams are such that all beams are interchangeable on all connector arms.

13. A demountable assembly according to claim 1, wherein a locking collar integral with said connector cooperates with locking collar securing means to secure the connector to the post.

* * * * *